US007909226B2

(12) United States Patent
Brüggenbrock et al.

(10) Patent No.: US 7,909,226 B2
(45) Date of Patent: Mar. 22, 2011

(54) DEVICE FOR PRODUCING A LONGITUDINALLY WELDED HOLLOW PROFILE USING A HOLDING-DOWN DEVICE

(75) Inventors: Michael Brüggenbrock, Rosendahl (DE); Thomas Flehmig, Ratingen (DE); Wladimir Rituper, Duisburg (DE); Mohamed Tohfa, Duisburg (DE)

(73) Assignee: ThyssenKrupp Steel AG, Duisburg (DE)

( * ) Notice: Subject to any disclaimer, the term of this patent is extended or adjusted under 35 U.S.C. 154(b) by 0 days.

(21) Appl. No.: 11/663,898

(22) PCT Filed: Sep. 8, 2005

(86) PCT No.: PCT/EP2005/009632
§ 371 (c)(1),
(2), (4) Date: Apr. 22, 2008

(87) PCT Pub. No.: WO2006/034773
PCT Pub. Date: Apr. 6, 2006

(65) Prior Publication Data

US 2009/0114703 A1 May 7, 2009

(30) Foreign Application Priority Data

Sep. 24, 2004 (DE) ..... 10 2004 046 687

(51) Int. Cl.
*B23K 37/00* (2006.01)
*B23K 1/18* (2006.01)
*B23K 31/02* (2006.01)
*B21J 13/08* (2006.01)

(52) U.S. Cl. ..... 228/17.5; 228/44.3; 228/49.3; 228/150; 219/61.11; 219/160

(58) Field of Classification Search ..... 228/150, 228/17.5, 44.5, 49.3; 219/59.1–61.13, 160; 72/368, 370.1, 400–402; 493/269
See application file for complete search history.

(56) References Cited

U.S. PATENT DOCUMENTS 1,290,578 A * 1/1919 Klocke ..... 72/398
1,899,143 A * 2/1933 Frahm et al. ..... 228/151
2,077,336 A * 4/1937 Lemming ..... 72/398
2,373,163 A * 4/1945 Cailloux et al. ..... 72/216
2,605,732 A * 8/1952 Anderson ..... 228/17.5

(Continued)

FOREIGN PATENT DOCUMENTS

DE 966111 C 7/1957

(Continued)

*Primary Examiner* — Kiley Stoner
*Assistant Examiner* — Carlos Gamino
(74) *Attorney, Agent, or Firm* — Proskauer Rose LLP

(57) ABSTRACT

A method for producing a longitudinally welded hollow profile from a sheet metal blank having defined longitudinal edges, in which the sheet metal blank is initially preformed into an open seam profile with the aid of at least two tool parts allows for the economical production of accurately formed hollow profiles. This is achieved in that to produce the open seam profile, the sheet metal blank, by a change in the relative position of the tools parts, is placed freely around a mandrel positioned between the tool parts and extending in the longitudinal direction of the sheet metal blank, the outer shape of which mandrel determines the inner shape of the hollow profile to be produced, and in that the shaping of the open seam profile obtained is then completed in one or more stages in each case by a further change of the relative position of the tool parts.

16 Claims, 8 Drawing Sheets

U.S. PATENT DOCUMENTS

| | | | | | |
|---|---|---|---|---|---|
| 2,623,973 | A | * | 12/1952 | Malke | 219/65 |
| 3,285,490 | A | * | 11/1966 | Roper | 228/17.5 |
| 3,418,706 | A | * | 12/1968 | White | 29/898.045 |
| 3,609,276 | A | * | 9/1971 | Cavagnero et al. | 219/64 |
| 3,732,614 | A | * | 5/1973 | Boutell | 228/150 |
| 4,187,406 | A | * | 2/1980 | Fencl et al. | 219/59.1 |
| 4,207,453 | A | * | 6/1980 | Astill | 219/61.11 |
| 4,339,941 | A | * | 7/1982 | Taira et al. | 72/412 |
| 4,395,900 | A | * | 8/1983 | Saurenman | 72/368 |
| 4,466,267 | A | * | 8/1984 | Casler et al. | 72/368 |
| 4,800,250 | A | * | 1/1989 | Watanabe et al. | 219/121.63 |
| 5,011,064 | A | * | 4/1991 | Fuss | 228/151 |
| 5,046,351 | A | * | 9/1991 | Takahashi et al. | 72/478 |
| 5,524,466 | A | * | 6/1996 | Coe | 72/62 |
| 5,657,922 | A | * | 8/1997 | Lowery et al. | 228/144 |
| 5,730,189 | A | * | 3/1998 | Randlett et al. | 138/171 |
| 5,839,644 | A | * | 11/1998 | Windle | 228/168 |
| 5,841,090 | A | * | 11/1998 | Taiana | 219/64 |
| 5,902,086 | A | * | 5/1999 | Enoki | 413/76 |
| 5,909,907 | A | * | 6/1999 | Oetiker | 29/33 R |
| 6,098,869 | A | * | 8/2000 | Bonsen | 228/147 |
| 6,288,355 | B1 | * | 9/2001 | Bonsen | 219/81 |
| 6,494,360 | B1 | * | 12/2002 | Flehmig et al. | 228/173.6 |
| 6,832,547 | B2 | * | 12/2004 | Makoui et al. | 101/23 |
| 7,003,999 | B2 | * | 2/2006 | Campo et al. | 72/94 |
| 7,325,435 | B2 | * | 2/2008 | Hamel et al. | 72/370.04 |
| 2008/0092615 | A1 | * | 4/2008 | Bruggernbrock | 72/51 |

FOREIGN PATENT DOCUMENTS

| | | |
|---|---|---|
| EP | 0701878 | 3/1996 |
| FR | 1254669 | 2/1961 |
| WO | WO 99/67037 | 12/1999 |

* cited by examiner

DEVICE FOR PRODUCING A LONGITUDINALLY WELDED HOLLOW PROFILE USING A HOLDING-DOWN DEVICE

FIELD OF THE INVENTION

The invention relates to a method for producing a longitudinally welded hollow profile from a sheet metal blank having defined longitudinal edges, in which the sheet metal blank is initially preformed into an open seam profile with the aid of at least two tool parts, which in each case have a recess, which determines the outer shape of at least one portion of the hollow profile to be produced and in which the longitudinal edges of the sheet metal blank which face one another in the region of the open seam profile are welded together.

The invention moreover relates to a device for producing a longitudinally welded hollow profile from a sheet metal blank having defined longitudinal edges, with at least two tool parts, the relative position of which is changeable and which in each case have a recess, which determines the outer shape of at least one portion of the hollow profile to be produced, and with a welding mechanism for welding the longitudinal edges of the sheet metal blank after its shaping to form an open seam profile.

BACKGROUND OF THE INVENTION

In the automotive industry, open, welded profiles are increasingly being replaced by thin-walled hollow profiles, the starting shapes of which consist of longitudinally welded tubes. Owing to small wall thicknesses, these components are designed such that a minimum weight is achieved with the highest exploitation of the material.

So that the technical functionality of so-called space/frame structures can be ensured, the production process of the components must be controllable through to the final shaping.

An important element of the process chain is, in this case the profile forming process, in which the tube elements being used as hollow profiles are formed. The discontinuous mode of operation, in other words forming from ready-cut blanks has proven successful for forming special profiles, so-called "tailored tubes". Tailored tubes are tube elements of the type which are composed of sheet metal portions, or their metal properties are adapted to the loads and requirements occurring during practical use or in the shaping process.

To form sheet metal blanks into finished welded profiles, there are various possibilities. Most solutions, however, use separate working stations for the forming and the welding (DE 44 32 674 C1).

A device of the type mentioned above, which allows the production of longitudinally welded tubular elements in a station is known from DE-PS 966 111, for example. In this device, the sheet metal blank is shaped to form an open seam tube and welded. For this purpose, a flat metal sheet is held between two tool halves which can be moved with respect to one another on a tool carrier, are arranged mirror symmetrically with respect to one another and in each case have a half shell-shaped recess determining the outer contour of the tube to be produced. The longitudinal edges of the sheet metal blank are, in this case, aligned parallel to the recesses of the tool halves in such a way that the tool halves receive the edges associated with them in each case when moved together and, viewed in cross-section, move them toward one another in the manner of an arc of a circle. During the moving together, the sheet metal blank is fixed by holders, which are positioned at the ends of the centre longitudinal axis of the sheet metal blank, which are associated with the two short edges of the sheet metal blank. It is thus ensured that the sheet metal blank, as a result of the moving together of the tool halves, in a uniform movement shifts along the contour predetermined by the recesses of the tool halves until its longitudinal edges meet one another at the apex point. The open seam tube thus formed is held in this position to weld its longitudinal edges. To make the open seam region of the open seam tube accessible, the upper end portions of the tool halves are folded up. The longitudinal edges associated with one another in the open seam region are then longitudinally welded to one another.

A decisive disadvantage of the procedure known from DE-PS 966 111 is that it assumes a certain minimum stiffness of the processed metal sheet. Only in this way is it ensured that, when the tool halves are moved together, the metal sheet curves uniformly to form the open seam tube. Thin metal sheets cannot be shaped in this known manner in a targeted manner, to form a tube with a accurately predetermined cross-sectional shape, but during the course of the shaping process form uncontrollable edges and folds, which may render the tube element obtained unusable. The welding of an open seam tube formed according to the method known from DE-PS 966 111 also leads to undesired shapings when the metal sheet is so thin that it cannot absorb forces unavoidably acting on it during welding.

An attempt to eliminate the disadvantages of devices of the type described above, is known from WO 99/67037. The procedure known from this document connects the forming and welding in one working station. For this purpose, a tool is used, which according to the model of DE-PS 966 111, has two tool halves which can be moved with respect to one another on a tool carrier, with a cylindrical half shell-shaped recess in each case. In addition, an inner mandrel half is associated in each case with the recesses of the tool halves, which inner mandrel half is positioned in the respective recess leaving free a gap between its outer face and the inner face of the recess and rigidly connected to the respective tool half. An annular gap is formed in this manner in the region of the recess of each tool half.

To form the tube element, the thin metal sheet to be shaped is placed between the tool halves in such a way that, during the subsequent moving together of the tool halves, its longitudinal edges are threaded into the annular gap formed in the respective tool half. When the tool halves are moved together further, the longitudinal edges shift further up the longitudinal gap and the metal sheet is bent to form an open seam tube. The support of the sheet metal blank taking place simultaneously on the inner and outer side of the sheet metal portion, in the region of the annular gap, ensures here that no undesired fold and edge formation occurs.

This forming process called "rolling-in" is completed when the longitudinal edges meet in the apex of the open seam tube obtained. Following after-rounding of the edge joint by means of a roller, this open seam tube can be welded in the region of its open seam, without the tube having to be brought into another device for this purpose.

The method known from WO 99/67037 is supposed to allow the production of accurately shaped tube elements, but has some disadvantages in practice, however. Thus, the divided design of the inner mandrel and the configuration of the annular gap in the region of the recesses of the tool halves requires high production accuracy in the production of the tools. The configuration of the machine is substantially more complex as to separate the finished welded tube from the divided inner mandrel expensive pulling units are required and special, very powerful holding-down devices are required for holding the mandrel position. The relative movement between the tool and metal sheet in the region of the unavoidably narrow annular gap also leads to damage to the surface of the metal sheet and to wear of the tools. Moreover, in particular when processing thin metal sheets, there is still the risk that during welding undesired shapings may occur in the region of the weld seam during welding because of the edge stresses occurring in the process.

SUMMARY OF THE INVENTION

Proceeding from the above-described prior art, the object of the invention consisted in providing a method and device, which, in a simple manner allow the economical production of accurately formed hollow profiles.

With regard to a method of the type mentioned above, this object is achieved according to the invention in that to produce the open seam profile, the sheet metal blank, owing to a change in the relative position of the tool parts, is placed freely around a mandrel positioned between the tool parts and extending in the longitudinal direction of the sheet metal blank, the outer shape of which mandrel determines the inner shape of the hollow profile to be produced, and in that the shaping of the open seam profile thus obtained is then completed in one or more stages in each case by a further change in the relative position of the tool parts.

In a corresponding manner, the above-mentioned object with respect to a device of the type mentioned above is achieved in that a device of this type according to the invention has a mandrel, the outer shape of which corresponds to the inner shape of the hollow profile to be produced, and a control mechanism, which emits control signals for changing the relative position of the tool parts, the change taking place in at least two stages, from a mutually distant starting position into a shaping position.

According to the invention the sheet metal blank to be shaped in each case into the hollow profile is rolled up around a mandrel, which determines the inner shape of the profile to be produced. The application of the sheet metal blank on the mandrel takes place in this case, with the aid of tool parts, which are moved relative to one another and to the mandrel. The relevant change in the relative position of the tool parts can take place here in that the tool parts are moved synchronously toward one another or away from one another. However, as an alternative, it is also possible to move the tool parts individually one after the other. In this case, the mandrel can stand still and the tool parts are moved toward it to shape the open seam tube. In the same way, it is also possible, however, to arrange one of the tool parts stationarily and to bring about the change in the relative position of the tool parts only by a movement of the second tool part. In this case, the sheet metal blank is actively inserted into the recess of the stationary tool part provided for shaping. This may take place with the aid of the second, movable tool part. In addition or as an alternative, the mandrel and the base plate can be used individually or jointly to hold the sheet metal blank during its deformation and to move it.

Recesses are formed in a manner already known per se into the tool parts and in the course of the shaping process engage under the longitudinal edges of the sheet metal blank associated with them and with continued movement toward one another force the sheet metal blank to move with its longitudinal edges along the inner face of the recesses. The movement, which is thus forced, of the sheet metal blank into the recesses, as also known per se from the prior art, leads to the sheet metal blank being preformed into an open seam profile. Owing to the mandrel, a targeted, controlled fold or bend formation is achieved, in this case, in the region of the hollow profile during this process, by means of which a rapid shaping is made possible.

In addition, the mandrel supports the metal sheet while it is being shaped, in that the sheet can rest on it, and thus allows production of the hollow profiles with minimised faults and is true to shape in short manufacturing times.

Once the sheet metal blank has been freely placed around the mandrel in the manner according to the invention, a calibration of the initially still roughly formed open seam profile obtained takes place in at least one further working step. This calibration is brought about by a further change in the relative position of the tool parts. Thus, the tool parts can be pressed against the mandrel for this purpose, optionally individually or together, in order to adapt the shape of the open seam profile perfectly to the final shape of the hollow profile predetermined by the production result to be aimed for. The open seam profile which is preformed in this manner can then be welded without problems.

When using a method according to the invention and by means of the use of a device according to the invention, it is therefore possible to form a hollow profile without expensive shaped elements having to be used for this purpose or the metal sheets to be processed having to be introduced in a laborious process which is prone to faults into guide slots or the like. The mandrel used according to the invention ensures in this case that particularly thin metal sheets can be processed to form hollow profiles which are formed accurately and without faults despite the circumstance that they are freely bent over wide sections of the shaping.

A configuration of the method according to the invention which particularly meets requirements in practice is characterised in that the sheet metal blank is placed on a base plate between the tool parts and the mandrel is then pressed against the metal sheet lying on the base plate in order to exert a holding force on the metal sheet, by means of which a lateral displacement of the metal sheet is prevented. The mandrel in this case fulfils a double function in that, on the one hand, it reproduces the shape of the hollow profile to be produced and, on the other hand, is used as a holder which ensures the reliable precisely positioned hold of the sheet metal blank while it is being shaped.

Owing to the force applied by the mandrel it is possible to emboss structures on the sheet metal blank in the support region. For this purpose, the mandrel can be designed in such a way that, in the region facing the sheet metal blank, it has a shape which is constant with respect to length. A shape of this type is present, for example, when the mandrel is configured in the form of a cylinder, a block, box or tube. A counterpiece corresponding to the mandrel is present, in this case, in the form of the counterplate. Owing to the force exerted by the mandrel, the sheet metal blank can be embossed between the base plate and the mandrel. It is also conceivable to only provide one recess in the base plate, the embossing taking place between the sheet metal blank and base plate owing to the force exerted by the mandrel and therefore, a positive connection can also be provided.

A further configuration of the invention which meets the requirements in practice consists in that, in addition to the non-positive connection, which is preferably produced by the mandrel, a positive connection can also be implemented of the type such that the transverse edges of the sheet metal blank are secured against slipping by shaped elements present on the two sides of the base plate by means of holding elements resting laterally on the sheet metal blank. Furthermore, a positive hold of the metal sheet can also be implemented in that elevations, for example, such as pins, bolts or the like are present on the base plate and cooperate positively with corresponding shaped elements, for example recesses, of the sheet metal blank. In the same way, suitable shaped elements can be implemented on the mandrel, which in turn cooperate with shaped elements of the metal sheet in order to ensure its positive hold.

According to a particularly preferred variant of the method according to the invention, the shaping of the sheet metal blank takes place in at least two stages. A shaping carried out in this manner proves particularly advantageous, in particular during the processing of thin metal sheets, when especially accurately formed hollow profiles are to be produced. Thus, production which takes place in multiple stages allows the open seam profile produced from the sheet metal blank to be preformed initially in a rough approximation of the final shape in order to then bring it to its end shape in one or more steps. This procedure accommodates the tendency of the metal sheets being processed in each case to not be shaped in a continuously extending arc when being pushed into the recesses of the tool parts, but to bend round step by step, the transitions between the individually bent stages being soft. The open seam profile formed from the sheet metal blank, at least in the first stage of shaping, then has a polygonal cross-section which, according to the invention, is then brought into its end shape in at least one further processing stage, the calibration process. In order to reliably avoid warping the metal sheet, in this case, a further configuration of the invention provides that during the next stage following the first stage of shaping, the longitudinal edges of the previously obtained open seam profile are guided by means of a holding-down device. A holding-down device of this type allows the longitudinal edges of the sheet metal blank to be aligned in the region of the open seam of the open seam profile formed from it in parallel and in a common plane. As the longitudinal edges of the sheet metal blank formed into the open seam profile are moved toward one another in the course of the calibration taking place after the first rough formation in the second stage of shaping, it is favourable if the holding-down device is adjusted such that the width of the open seam of the open seam profile is reduced during each stage of the calibration. In order to ensure a controlled shaping of the metal sheet, in this case, during each stage of the calibration, the longitudinal edges in the region of the open seam of the open seam profile can be held at the predetermined spacing.

The reliable support of the open seam profile ensured by the holding-down device, even in the region of its open seam, makes it possible to also carry out a smoothing of the edges of the sheet metal blank in addition to the calibration effect prior to the longitudinal welding. In this manner, high-quality weld seams can be produced such as are required, in particular in the production of components for car body construction.

In a device according to the invention, according to an advantageous configuration of the invention, a recess is formed into the mandrel, the recess being positioned in the region which is associated with the longitudinal weld seam to be produced on the profile to be produced. The welding process is simplified by a recess of this type as the risk of welding the profile to the mandrel is eliminated. Moreover, the recess can be used to collect welding residues, such as slag or slivers of metal. For this purpose, a heat-resistant collecting strip can be arranged in the recess to collect waste materials occurring during welding.

The method according to the invention does not necessarily, however, assume that the mandrel remains in the open seam profile during welding. Rather, it has been found that the tool parts used according to the invention and the inherent stiffness achieved during the calibration of the open seam tube are in many cases sufficient with corresponding sheet metal qualities to ensure adequate non-deformability of the open seam profile even during the welding. It is therefore provided according to a further variant of the invention, to remove the mandrel from the open seam profile between the calibration and the welding of the open seam profile. For this purpose, a holding mechanism can be provided, which is designed, for example, in the form of hooks and, if necessary, engages in the open seam of the open seam profile to keep the open seam to a desired dimension during the slight return movement of the tool parts required to move out the mandrel. The mandrel can then be drawn without problems from the open seam profile. The tool parts are then moved together again in a defined manner, so the open seam profile is securely held for the welding process and the edge joint is closed.

It is basically possible to produce the mandrel from a solid material. This is expedient, in particular, when further functional elements are used in the mandrel which are required to form the hollow profile or to remove the mandrel from the finished hollow profile. Alternatively, the mandrel itself can also be produced, however, from a hollow profile, for example in the shape of a dimensionally stable tube. Its interior can then be used, for example, for collecting the welding residues.

Drawing the mandrel out from the finished hollow profile can be simplified in that the outer shape of the mandrel is smaller by a slight undersize than the inner shape of the hollow profile to be produced. Practical tests have shown that it is sufficient if this undersize is up to 0.2 mm compared to the desired inner shape of the hollow profile to be produced.

Auxiliary shaped elements, such as beads or similar embossings, can easily be produced on hollow profiles produced in a manner according to the invention in that in a device according to the invention the mandrel has an embossing mechanism to emboss the metal sheet placed around it. A mandrel may also have non-longitudinally constant auxiliary structures for embossing, assuming the possibility exists to remove the mandrel after the shaping, which is the case, for example, with a conical basic structure. In order to also reliably configure larger volume shaped elements in this case, the embossing device can be configured for this purpose as a embossing tool which can be moved beyond the periphery of the mandrel and shaped elements can be provided in the recesses of the tool parts as a counterpiece for the shaping produced by the embossing mechanism. An embossing mechanism can be provided in a corresponding manner in the region of at least one of the recesses of the tool parts, with it also being possible for the embossing mechanism to be configured as a embossing tool and a shaped element to be configured in the mandrel as a counterpiece for the shaping produced by the embossing mechanism. The embossing mechanisms used in each case are preferably hydraulically operated in order to reliably be able to exert the required pressing forces. It is also conceivable, to use pneumatically, mechanically or electrically driven embossing mechanisms.

The procedure according to the invention, in which the longitudinal edges of the sheet metal blank to be shaped, in the first shaping step, move freely along the inner faces of the recess provided in the tool parts, makes it possible to produce hollow profiles with non-uniform cross-sectional shapes without problems. For this purpose, the recesses formed into the tool parts may be configured differently, the mandrel being correspondingly adapted to the different shape of the recesses.

In order to allow the multi-stage calibration, the device according to the invention can be equipped with a holding-down device, which can be fed in the direction of the mandrel. This holding-down device, with regard to an at least two-stage calibration, preferably has a first shoulder, the thickness of which corresponds to a first width of the gap of the open seam profile to be preformed from the sheet metal blank, and at least a second shoulder, the thickness of which is the same as the second width of the gap of the open seam profile. If a recess, which extends along the weld seam to be produced, is provided in the mandrel, the portion with the smallest thickness may have a height, which is greater than the thickness of the sheet metal blank to be shaped. This portion can then be introduced into the recess which is used as a guide and easily allows correct positioning of the mandrel. A further advantageous configuration of the invention in this connection is characterised in that at least one deflection face is configured on the holding-down device, which when the holding-down device is located in the operating position, is positioned in such a way that it deflects a longitudinal edge of sheet metal blank impacting on it, in the direction of the mandrel.

After the welding, there is the possibility of further changing the shape of the hollow profile obtained by hydro forming. With the tool parts still moved together, auxiliary shaped elements can be introduced into the hollow profile by this hydro forming. For this purpose, the tool elements can be provided with shaped elements, such as recesses, into which the metal sheet is pressed during the hydro forming.

BRIEF DESCRIPTION OF THE FIGURES

Further advantageous configurations of the invention emerge from the dependent claims and are described in more detail below with the aid of drawings showing embodiments, in which, unless otherwise stated, schematically in each case, in a vertical section transversely to the longitudinal extension:

DETAILED DESCRIPTION

Figures 1, 2:
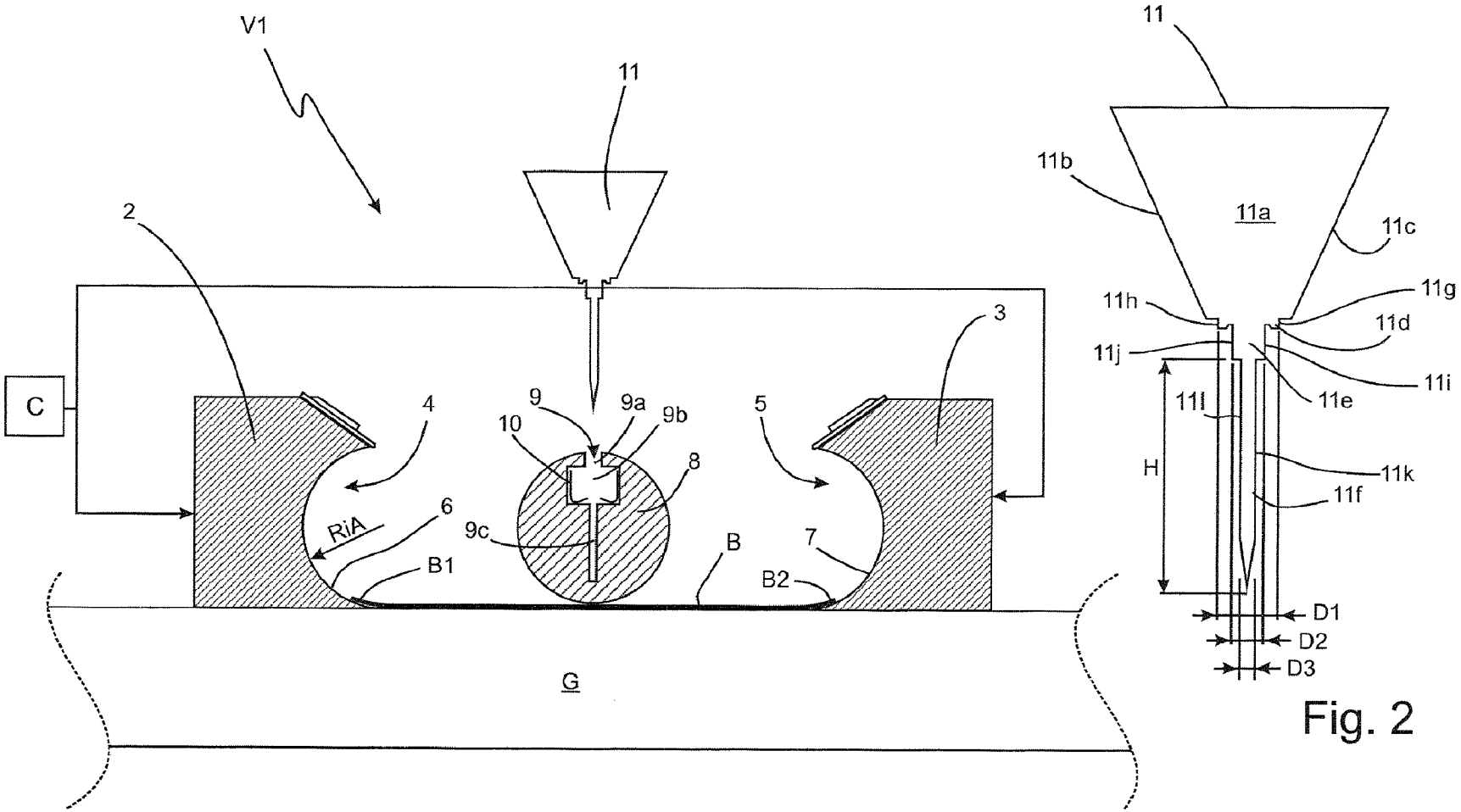
FIG. 1 shows a first device for forming a hollow profile in the starting position.
FIG. 2 shows a holding-down device used in the device shown in FIG. 1.

The device V1 shown in FIGS. 1 to 9 for producing a longitudinally welded hollow profile R, which has the shape of a circular tube, comprises two tool parts 2, 3, which are mounted so as to be displaceable with respect to one another on a base plate G. The working length of the device V1 for producing hollow profiles R is for example up to 3,000 mm.

To move the tool parts 2, 3 toward one another and apart, control mechanisms, C, are provided, of which, in each case, a plurality, for example four, may be arranged distributed in the longitudinal direction of the tool parts 2, 3, to ensure as uniform a movement as possible of the tool parts 2, 3 and an equally uniform transfer of the forces exerted by the tool parts 2, 3. The control mechanisms, C, are designed, in this case, such that they move the tool parts 2, 3 at a speed of 1 mm/s to 80 mm/s and, in this case, can exert a force of at least 7,500 kN.

A half shell-shaped recess 4, 5 is formed, in each case, into the side of the tool parts 2, 3 associated with the respective other tool part 2, 3. The radius RiA of the curvature of the inner faces 6, 7 of the recess 4, 5, in this case, corresponds to the outer radius RaR of the tubular hollow profile R to be produced.

Figure 13:
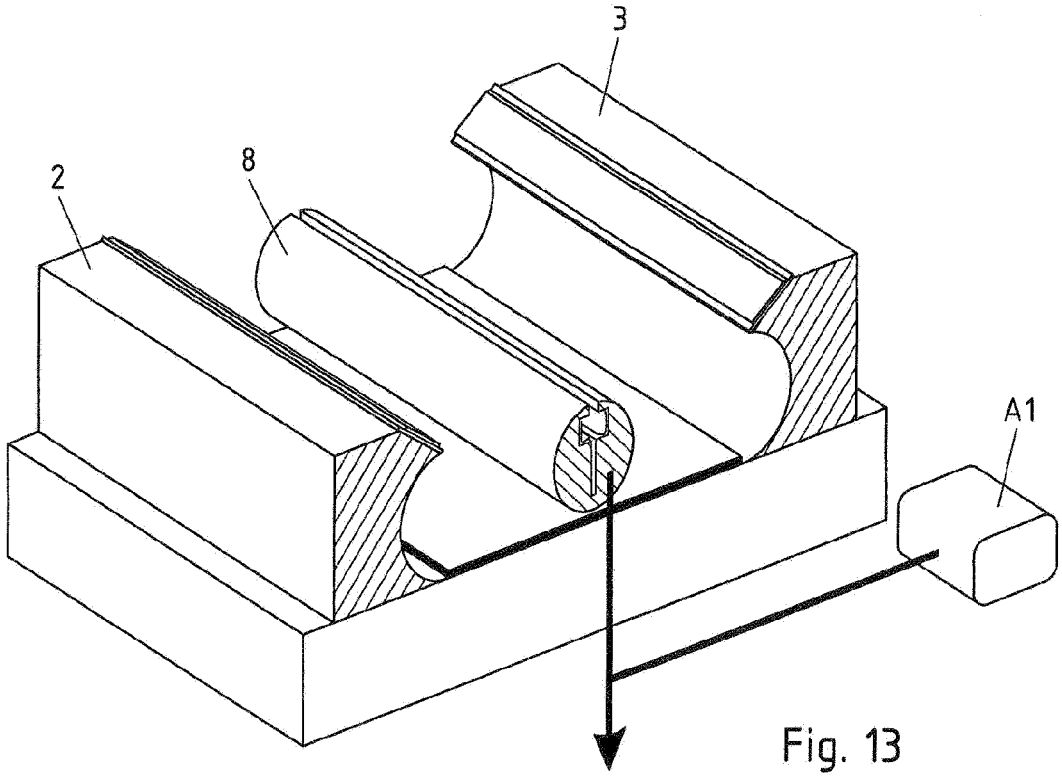
FIG. 13 shows a device in accordance with the invention in perspective view with the mandrel located in an operating position exerting a force against a blank.

Furthermore, the device V1 has a mandrel 8 which is produced from a solid material and which can be moved from a removal position, not shown here, into a working position, in which it is arranged centrally between the tool parts 2, 3. The mandrel 8 can be adjusted, in this case, in the vertical direction, via a suitable adjusting mechanism A1 to exert a holding force on a sheet metal blank B placed on the base plate G between the tool parts 2, 3 located in the starting position (as shown in FIG. 13).

In the region of its apex remote from the base plate G, a groove-shaped recess 9 is formed into the mandrel 8 and widens, proceeding from a narrow portion 9*a* associated with the periphery of the mandrel 8, into a chamber 9*b*, in the base of which a slot 9*c* is formed, the width of which is in turn smaller than the width of the portion 9*a*. The width of the narrow portion 9*a* of the recess 9 corresponds, with an oversize to the width of the weld seam S to be produced on the hollow profile R to be produced. The width of the slot 9*c* aligned centrally to the narrow portion 9*e* is smaller than the width of the portion 9*a*.

Collecting strips 10, which are used to collect welding residues, are arranged in the chamber 9*b*. The collecting strips 10 consist of a heat-resistant material and can be drawn out of the mandrel 8 via openings, not shown.

Furthermore, the device V1 comprises a holding-down device 11 in the shape of a sword, the length of which corresponds to the length of the mandrel 8. The holding-down device 11 can be moved by means of an adjusting mechanism, A2, from its working positions associated with the mandrel 8 into a waiting position arranged laterally to the tool part 2.

The holding-down device 11 has an upper portion 11*a* configured in a roof-like manner in cross-section, the shoulders 11*b*, 11*c* of which, viewed in cross-section, are aligned obliquely tapering toward one another downwardly and to the inside. A first shoulder 11*d*, which extends over the length of the holding-down device 11 and which is aligned, viewed in cross-section, centrally with respect to the portion 11*a*, adjoins the portion 11*a*. The thickness D1 of the first shoulder 11*d*, between face 11*g* and face 11*h*, corresponds to the width of the open seam Z of an open seam profile Sr formed from the sheet metal blank B after a first shaping stage.

Arranged below the first portion 11*d* and, viewed in cross-section, centrally thereto, is a second shoulder 11*e* of the holding-down device 11. This shoulder 11*e* also extends over the length of the holding-down device. Its thickness D2, between face 11*i* and face 11*j*, corresponds to the width of the open seam Z of the open seam profile Sr after a second stage of calibration.

Finally, a cutting edge-like, thin third shoulder 11*f* is formed on the second shoulder 11*e* of the holding-down device 11 and is also arranged, viewed in cross-section, centrally with respect to the other shoulders 11*d*, 11*e* of the holding-down device 11 and extends over the length thereof. The thickness D3 of the third portion, between face 11*k* and face 11*l*, is slightly smaller than the width of the slot 9*c*, which is formed into the base of the chamber 9*b* in the mandrel 8. The height H of the third portion 11*f* is greater, in this case than the spacing of the opening of the slot 9*c* in the base of the chamber 9*b* from the periphery of the mandrel 8. At its end, the third portion tapers in the manner of a blade, viewed in cross-section.

With the aid of the adjusting mechanism, A2, the holding-down device 11 is lowered in the direction of the mandrel 8. In this case, its third portion 11*f* firstly dips into the recess 9 and is introduced into the slot 9*c*. The slot 9*c* thus forms a guide for the holding-down device 11 during the shaping process. In the course of the calibration of the hollow profile R, the holding-down device 11 is drawn in one or more steps.

To weld the open seam profile Sr formed from the sheet metal blank B, a laser welding mechanism 12 is preferably used. However, it is also conceivable to use other welding units, for example inductively working welding mechanisms, which allow economical welding of the longitudinal edges B1, B2 associated with one another in the region of the open seam Z of the open seam profile Sr.

The laser welding mechanism 12 is fastened in a carrier 13, which can be moved along the open seam Z by means of an adjusting mechanism, A3. Furthermore, the carrier 13 carries an after-forming roller 14, which is arranged in the welding direction F with a small spacing in front of the laser welding mechanism 12. The edge joint acts with a certain force against the path-controlled after-forming roller 14, to eliminate a roof-shaped edge formation and avoid a spring-back of the edges B1, B2 of the hollow profile R in the seam region. At least the laser welding mechanism 12 should be surrounded by a housing, not shown here, to protect the operator from the light radiation.

In addition, the carrier 13 may carry a cleaning mechanism, not shown here, which cleans the welding region before the laser welding mechanism 12 reaches it. The cleaning mechanism can suck away, brush off or rinse away the dirt present in front of the welding region.

To level the edges B1, B2, sliding blocks 15 or rollers can be provided, which are also fastened to the carrier 13. The carrier 13 may moreover carry a supply line, via which inert gas is guided into the welding region. The carrier is preferably moved by an adjusting mechanism, A3, which can be controlled in precisely three degrees of freedom (X-, Y-, Z-direction).

In order to increase the production rate when using a melt beam welding source, the device V1 can be designed as a twin device. This allows one device to be loaded with a new sheet metal blank B and to form this while the welding is still being carried out in the other device.

At the beginning of the shaping process, the sheet metal blank B rests on the base plate G. It is rigidly and non-displaceably pressed against the base plate G by the mandrel 8, the lower side of which has a small level face. For this purpose, the holding-down device 11 is lowered with its blade-like portion 11*f* into the slot 9*c* of the recess 9, until the upper portion 11*a* of the holding-down device 11 sits on the mandrel 8 and acts with a defined pressure force on the mandrel 8 (FIG. 1).

The two tool parts 2, 3 are then pushed toward one another, so the edges B1, B2 of the sheet metal blank B associated in each case with the tool parts 2, 3 are firstly pressed up and then gradually bend in. If the mandrel 8 approaches the straight, unbent leg of the sheet metal blank B, it presses this so as to be curved to such an extent that further bends are produced.

Figure 3:
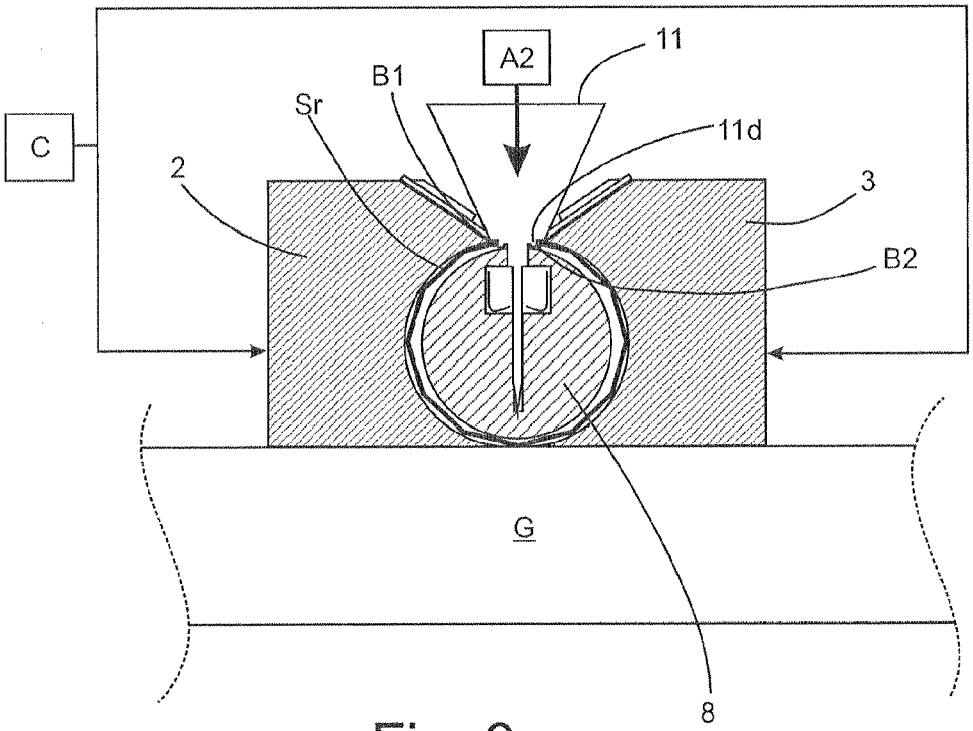
FIGS. 3 to 8 in each case show an operating position of the device according to FIG. 1 during the shaping of a sheet metal blank to form the hollow profile.

During continued rolling up of the sheet metal blank B, the sheet metal edges B1, B2 impact against the oblique shoulders 11*b*, 11*c* of the holding-down device 11. At the oblique shoulders 11*b*, 11*c*, the edges B1, B2 are deflected in the direction of the mandrel 8. If they arrive at the outer face 11*h*, 11*g* of the upper shoulder 11*d*, a pressure is produced in the sheet metal blank B, which leads to a specific calibration effect with the result that the bend points are flattened (FIG. 3).

Figure 4:
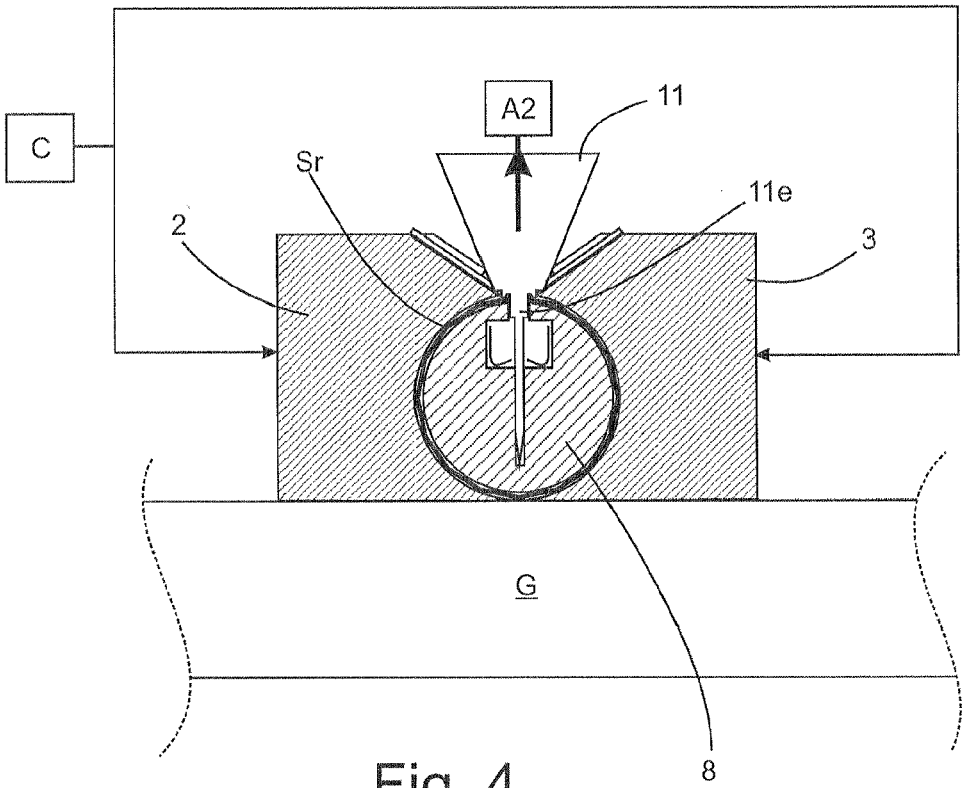

After relieving the pressure on the holding-down device 11 by slightly moving up the tool parts 2, 3, the holding-down device 11 is pulled until its second shoulder 11*e* becomes free and stands in the region of the open seam, which is limited by the edges B1, B2 of the sheet metal blank B. When the tool parts 2, 3 are moved further together, the edges B1, B2 also impact against the second portion 11*e* at faces 11*i*, 11*j* so a calibration effect is also produced here with an improvement of the roundness of the open seam profile Sr formed from the sheet metal blank B (FIG. 4).

Figure 5:
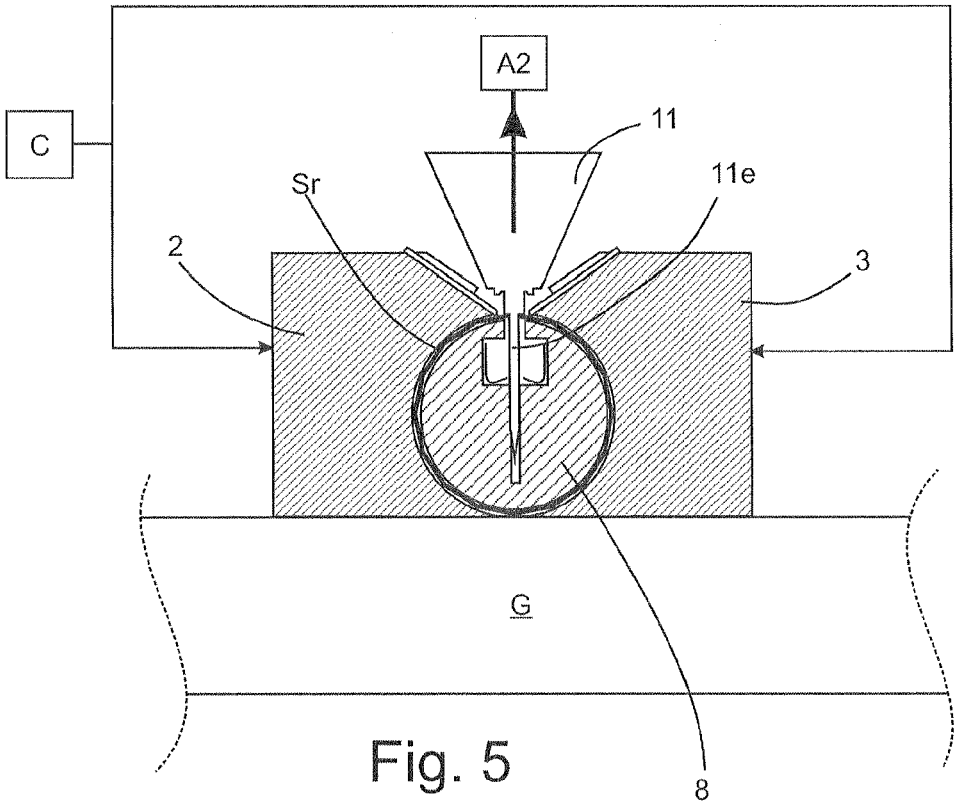

Once the sword has in turn been relieved of pressure by slightly moving up the tool parts 2, 3, the holding-down device 11 is raised so far that its narrow portion 11*f* is arranged in the region of the open seam Z (FIG. 5).

Figure 6:
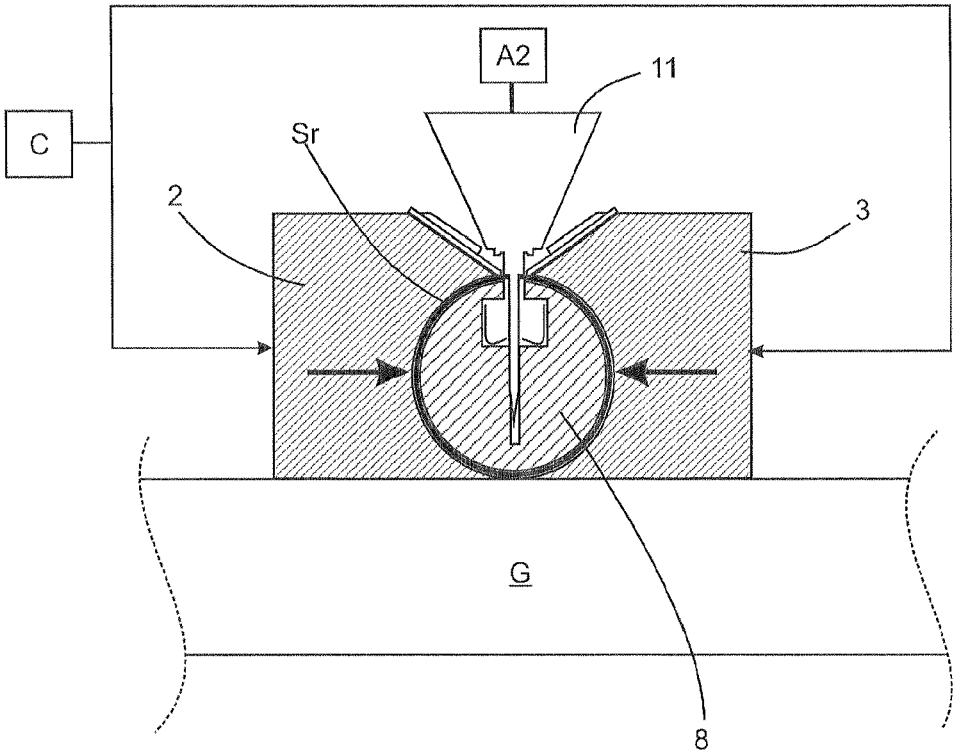

The tool parts 2, 3 are then moved toward one another against faces 11*k*, 11*l* with a high pressure, so precise calibration of the open seam profile Sr is adjusted with the formation of the desired roundness and linearity of the band edges, which then produce an ideal joint. The gap remaining between the mandrel 8 and the tool parts 2, 3 is only minimal, in this case (FIG. 6).

Figure 7:
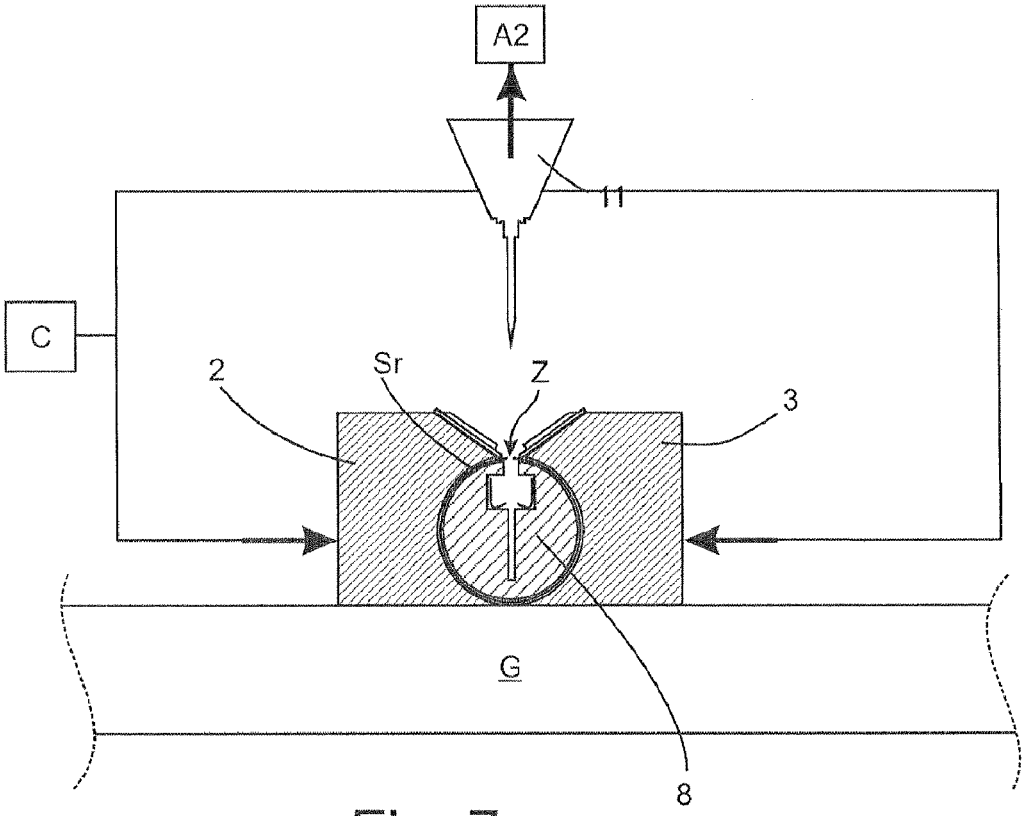

After the last calibration, the holding-down device 11 is drawn from the recess 9. The pulling movement of the holding-down device 11, can be combined, in this case, with a further moving together of the tool parts 2, 3, so the tip thereof is in the region of the open seam Z and ensures that the edges B1, B2 of the open seam profile remain precisely in the centre (FIG. 7).

Once the holding-down device 11 has been completely drawn, the open seam profile Sr is completely formed and ready for welding. For welding, the holding-down device 11 is moved laterally out of the edge region into its rest position and the after-rounding and welding unit formed from the carrier 13, the laser welding mechanism 12, the after-forming roller 14, the sliding block 15 and the other elements, not shown here, is moved in.

Figure 8:
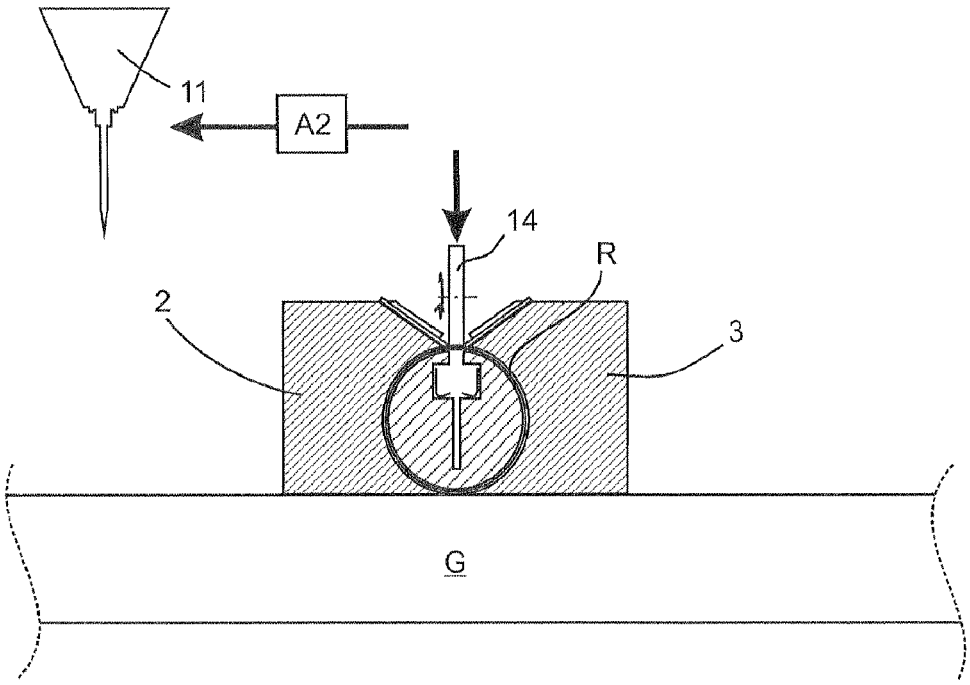
Figure 9:
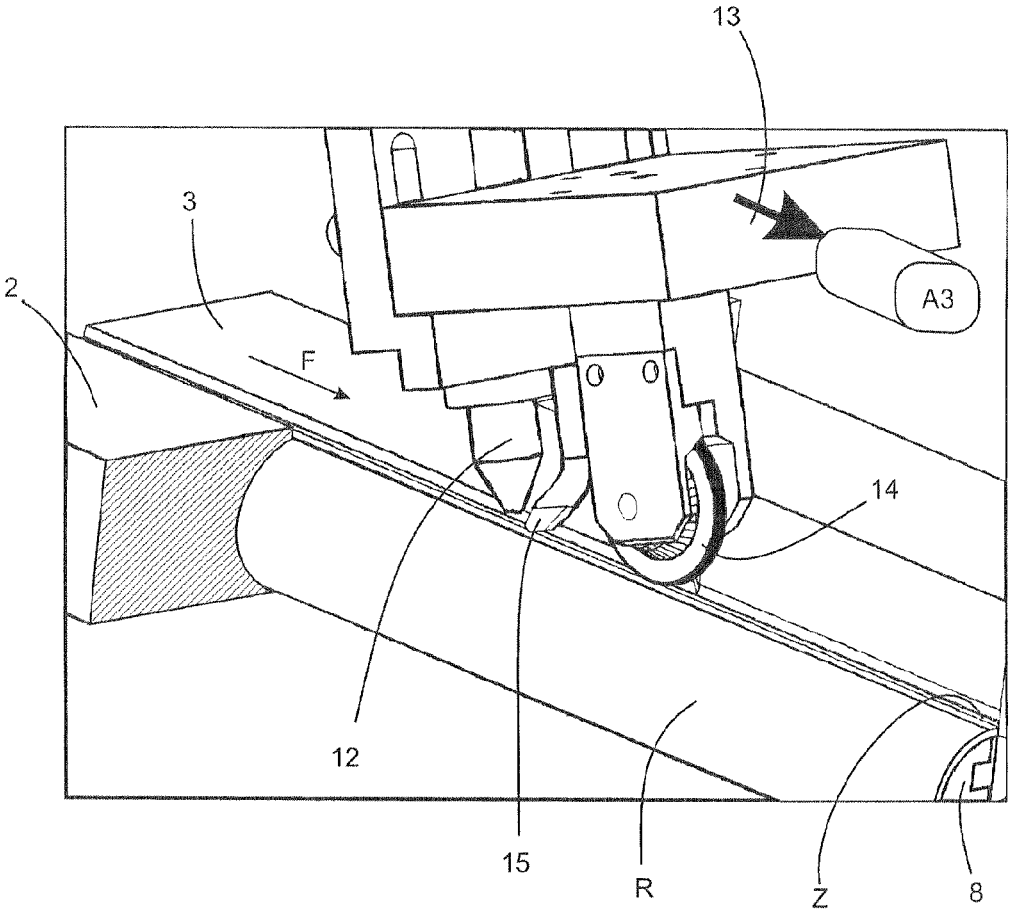
FIG. 9 shows the device according to FIG. 1 during the welding of an open seam profile formed from the sheet metal blank in a part cutout in a partially broken open perspective view.

When moving over the edge joint formed in the region of the open seam Z from one tube end to the other, the after-forming roller 14 initially presses the edges B1, B2 down in a defined manner. In this case, an after-rounding can also be carried out if the edges B1, B2 have not been configured so as to be adequately round by the calibration. Following the after-forming roller 14, the sliding block 15 or a correspondingly acting roller can press away the spring-back and the height differences of the edges B1, B2 directly in front of the laser welding mechanism 12, so an ideal I-join is produced. The open seam Z is then welded closed by the laser beam emitted by the laser welding mechanism 12 (FIGS. 8, 9).

After welding, if it is expedient, a closing calibration process may take place.

After slight relieving of pressure from the mandrel 8 by moving up the tool parts, a drawing unit pulls the mandrel 8 out of the finished hollow profile R. The finished hollow profile R is now ready for removal. A new manufacturing process begins with the positioning of the tool-parts 2, 3, the insertion of the sheet metal blank B and the positioning of the mandrel 8 over the sheet metal blank B (FIGS. 12*a*, 13).

In the procedure described above, the tool parts 2, 3 were moved synchronously with respect to one another against the mandrel 8. According to an alternative not shown here, it is also possible, however, in the scope of the invention, to carry out the change in the relative positions of the mandrel 8 and tool parts 2, 3 required for forming the open seam profile 8 in that the tool parts are moved one after the other in the direction of the mandrel 8. In order to thus ensure an adequate hold of the sheet metal blank B, the mandrel 8 can be pressed so firmly against the sheet metal blank B that slipping during the shaping is reliably avoided. The secure hold of the sheet metal blank B can be assisted during shaping in addition by the fact that shaped elements in the form of pins are provided on the base plate G, which engage in corresponding recesses of the sheet metal blank B, so not only a non-positive hold of the sheet metal blank B is ensured, but also a positive one. The tool part 2 can then be displaced in a first step in the direction of the mandrel 8 to form the first half of the open seam profile Sr. The second tool part 3 is then displaced in the direction of the mandrel 8 in order to also produce the second half of the open seam profile Sr.

A further possibility for implementing the invention, which particularly meet the requirements in practice is shown in FIGS. 10*a* to 12. The device V2 shown there has tool parts 102, 103 which are designed in accordance with the tool parts 2, 3 of the device V1 and, in each case, have a recess 104, 105. Likewise, the device has a mandrel 108 formed just like the mandrel 8, a holding-down device 111 formed like the holding-down device 11 and a base plate G2.

In contrast to the device V1, however, in the case of the device V2, the first tool profile 102 is stationarily arranged, while the tool part 103 can be moved by means of suitable control mechanisms, not shown here, toward the stationary tool part 102 or away from it.

Likewise, in the case of the device V2, the mandrel 108 with the holding-down device 111 can be moved in a horizontal direction toward the tool part 102 or away from it.

The base plate G2, on which the tool 103 is displaceably mounted can also be moved horizontally by suitable mechanisms, not shown here, in the direction of the stationary tool part 102. In this case, shaped elements 116, 117 in the form of pins are provided on the base plate G2 in the region of the transverse edges B3, B4 of the sheet metal blank Bz to be shaped in the device V2 into a tubular open seam profile Sr2. These pin-shaped shaped elements 116, 117, when the sheet metal blank Bz is placed on the base plate G2, engage positively in recesses B5, B6, which are formed, centrally arranged, in the transverse edges B3, B4 of the sheet metal blank Bz.

To allow the mandrel 108 to be placed on the sheet metal blank Bz, it has, in the region of its end faces on its side associated with the base plate G2, a recess 118, in each case, in which the shaped elements 116, 117 engage when the mandrel 108 is pressed onto the sheet metal blank Bz.

Figure 10A:
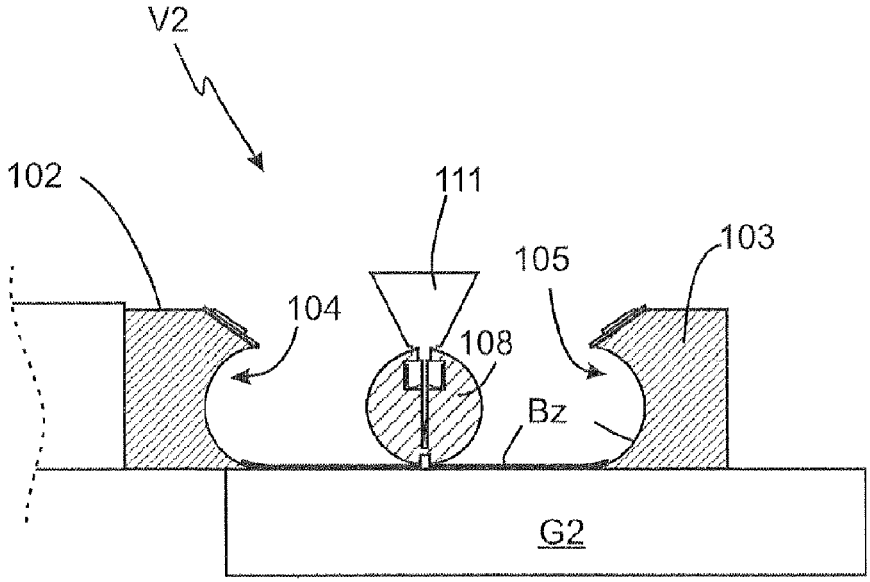
FIG. 10*a* shows a second device for forming a hollow profile in the starting position.
Figure 10B:
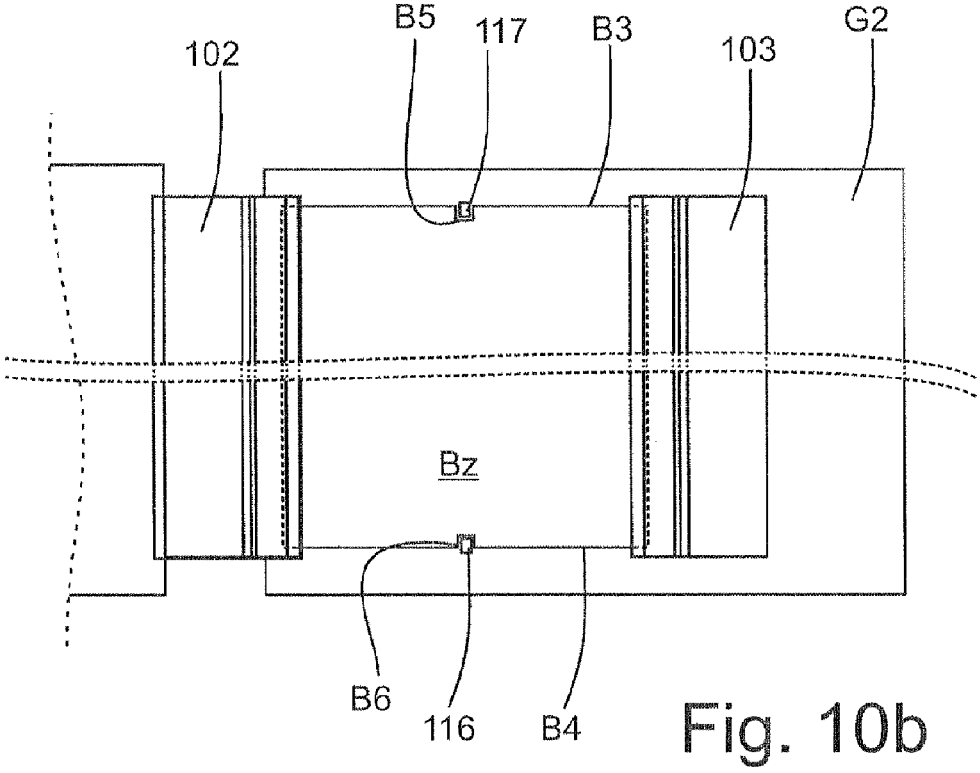
FIG. 10*b* shows the device according to 10*a* in a view from above.

To shape the respective sheet metal blank Bz into the open seam profile Sr2, the sheet metal blank Bz is placed on the base plate G2, so the shaped elements 116, 117 engage in the recesses B5, B6 of the sheet metal blank Bz and it is positively held. The sheet metal blank Bz is thus arranged centrally below the mandrel 108, which is then lowered until it presses with an above-described holding force on the sheet metal blank Bz. A design is also conceivable in which a non-positive connection is applied by means of the mandrel 108 and therefore the shaped elements 116, 117 with the recesses B5, B6 in the sheet metal blank Bz can be dispensed with. Furthermore, structures in the support region of the mandrel can also provide a non-positive connection. The movable tool part 103 is, in this case, located in its starting position remote from the stationary tool part 102, in which the longitudinal edges B1, B2 of the sheet metal blank Bz are located in the entry of the recesses 104, 105 of the tool parts 102, 103 associated with them in each case. The base plate G2 is simultaneously in a drawn back starting-position in which its longitudinal edge associated with the fixed tool part 102 is arranged just below it (FIGS. 10*a*, 10*b*).

Figure 11:
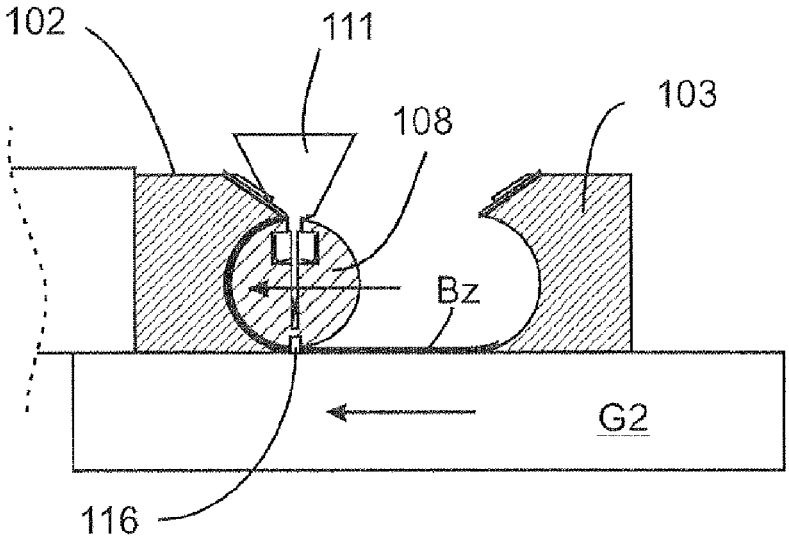
FIG. 11 shows the device according to FIGS. 10*a*, 10*b* in a second operating position.

To shape the sheet metal blank Bz, the base plate G2 is then moved with the tool part 103 which is still at a standstill and arranged thereon in the direction of the stationary tool part 102. Synchronously with this, the mandrel 108 is also displaced with the holding-down device 111 in the direction of the tool part 102, the holding force exerted on the sheet metal blank Bz being maintained. The sheet metal blank Bz is forced in this manner to move with its longitudinal edge B1 into the recess 104 of the tool part 102. This movement is completed when the longitudinal edge B1 meets the holding-down device 111 and the mandrel 108 is moved into the recess 104 (FIG. 11).

Figure 12:
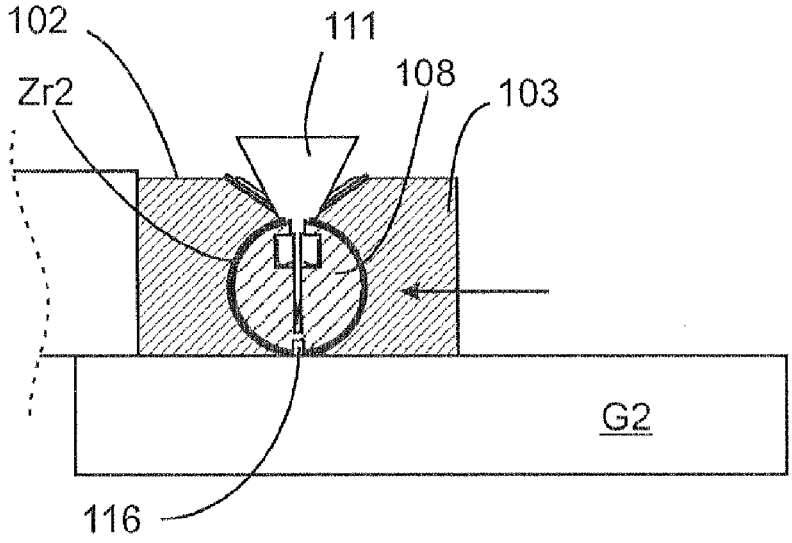
FIG. 12 shows the device according to FIGS. 10*a*, 10*b* in a third operating position.

As soon as this position is reached, in a further step, the movable tool half 103 is displaced on the base plate G2, which is now at a standstill, in the direction of the mandrel 108. The longitudinal edge B2 of the sheet metal blank Bz is displaced, in this case, into the recess 105 of the tool part 103, until it also meets the holding-down device 111 and the tool part 103 has reached the mandrel 108 (FIG. 12).

It is also conceivable to move the base plate G2 simultaneously with the tool part 103, the speed of the base plate G2 corresponding to half the speed of the tool part 103, so the shaping of the sheet metal blank Bz to form an open seam profile Sr2 can take place in one processing step.

A multi-stage calibration of the open seam profile Sr2 obtained then takes place, in which, step by step, the mandrel 108 with a base plate G2 and the holding-down device 111 and the tool part 103 are displaced on the base plate G2 in the direction of the stationary tool part 102.

The welding of the open seam of the open seam profile Sr2 and the removal of the mandrel 108 from the finished hollow profile then take place in accordance with the procedure described for the device V1.

LIST OF REFERENCE NUMERALS

V1, V2 devices for producing a longitudinally welded hollow profile R
2, 3, 102, 103 tool parts
4, 5, 104, 105 half shell-shaped recesses
6, 7 inner faces of the recesses
8, 108 mandrels
9 recess
9*a* narrow portion of the recess 9
9*b* chamber
9*c* slot
10 collecting strips
11, 111 holding-down devices
11*a* upper portion of the holding-down device 11
11*b*, 11*c* shoulders of the portion 11*a*
11*d* first shoulder of the holding-down device 11
11*g*, 11*h* faces of the first shoulder 11*d*
11*e* second shoulder of the holding-down device 11
11*i*. 11*j* faces of the second shoulder 11*e*
11*f* third shoulder of the holding-down device 11
11*k*, 11*l* faces of the third shoulder 11*f*.
12 laser welding mechanism
13 carrier
14 after-forming roller
15 sliding block
116, 117 shaped elements in the form of pins
B, Bz sheet metal blanks
B1, B2 longitudinal edges of the sheet metal blanks B, Bz B3, B4 transverse edges of the sheet metal blanks B, Bz
B5, B6 recesses on the transverse edges of the sheet metal blanks B, Bz
D1 thickness of the first shoulder 11*d* of the holding-down device 11
D2 thickness of the second shoulder 11*e* of the holding-down device 11
D3 thickness of the third shoulder 11*f* of the holding-down device 11
F conveying direction
G, G2 base plates
H height of the third shoulder 11*d* of the holding-down device 11
N weld seam
R hollow profile
RiA radius of curvature of the inner faces 6, 7
RaR outer radius of the hollow profile R to be produced
S weld seam of the hollow profile R to be produced
Sr, Sr2 open seam profiles
Z open seam of the open seam profile Sr
C control mechanism
A1, A2, A3 adjustment mechanisms
R hollow profile

What is claimed:

1. Device for producing a longitudinally welded hollow profile from a sheet metal blank having defined longitudinal edges, the device comprising:

at least two tool parts, each tool part having a recess that determines an outer shape of at least one portion of the hollow profile to be produced and each tool part moveable relative to at least one other tool part to change a relative position of the tool parts, a mandrel having an outer shape that determines an inner shape of the hollow profile to be produced, a welding mechanism for welding the longitudinal edges of the sheet metal blank after the sheet metal blank has been shaped to form an open seam profile, a control mechanism that emits control signals for changing the relative position of the tool parts from a mutually distanced starting position into a shaping position, wherein the changing of the relative position occurs in at least two stages, and a holding-down device for holding down the mandrel, wherein the holding-down device is configured to be fed in a direction of the mandrel to form a guide for the longitudinal edges of the sheet metal blank, the holding-down device comprising:

a first portion having:

two faces that are aligned parallel to each other, and a first thickness between the two faces that determines a first width of a gap of the open seam profile to be formed from the sheet metal blank during a first stage, and a second portion having:

two faces that are aligned parallel to each other, and a second thickness between the two faces that determines a second width of the gap of the open seam profile to be formed during a second stage, wherein the second thickness is different than the first thickness.

2. Device according to claim 1, wherein an adjusting mechanism is provided to move the mandrel from an operating position, in which the mandrel is positioned between the tool parts and over the sheet metal blank to be shaped, into a removal position, in which a finished hollow profile can be removed from the device.

3. Device according to claim 2, wherein a mandrel recess is formed into a region of the mandrel that is associated with a longitudinal weld seam to be produced on the hollow profile to be produced.

4. Device according to claim 3, wherein a collecting strip for collecting waste materials occurring during welding is arranged in the mandrel recess.

5. Device according to claim 1, wherein the mandrel has longitudinally constant structures in a support region.

6. Device according to claim 1, wherein the outer shape of the mandrel is smaller by a small undersize than the inner shape of the hollow profile to be produced.

7. Device according to claim 1, wherein the recesses formed into the tool parts are configured differently.

8. Device according to claim 1, wherein a portion of the holding down device having a smallest thickness also has a height that is greater than a thickness of the sheet metal blank to be shaped.

9. Device according to claim 1, wherein the holding-down device further comprises at least one oblique shoulder that is configured to deflect a longitudinal edge of the sheet metal blank impacting on it in the direction of the mandrel when the holding-down device is located in an operating position.

10. Device according to claim 1, wherein one tool part is stationarily arranged.

11. Device according to claim 1, wherein a base plate can be moved in a same movement direction in which the change of the relative position of the tool parts takes place.

12. Device according to claim 1, wherein the mandrel can be moved in a same movement direction in which the change of the relative position of the tool parts takes place.

13. Device according to claim 1, wherein shaped elements are configured on a base plate and cooperate with corresponding shaped elements of the sheet metal blank to be shaped in each case to positively hold a respective sheet metal blank and/or preembossing it.

14. Device according to claim 1, wherein shaped elements are configured on the mandrel and cooperate with corresponding shaped elements of the sheet metal blank to be shaped in each case to positively hold a respective sheet metal blank and/or preembossing it.

15. Device for producing a longitudinally welded hollow profile from a sheet metal blank having defined longitudinal edges, the device comprising:

at least two tool parts, each tool part having a recess that determines an outer shape of at least one portion of the hollow profile to be produced and each tool part moveable relative to at least one other tool part to change a relative position of the tool parts, a mandrel having an outer shape that determines an inner shape of the hollow profile to be produced, a control mechanism that emits control signals for changing the relative position of the tool parts from a mutually distanced starting position into a shaping position, wherein the changing of the relative position occurs in at least three stages, and a holding-down device for holding down the mandrel, wherein the holding-down device is configured to be fed in a direction of the mandrel to form a guide for the longitudinal edges of the sheet metal blank, the holding-down device comprising:

a first portion having:

two faces that are aligned parallel to each other, and a first thickness between the two faces that determines a first width of a gap of the open seam profile to be formed from the sheet metal blank during a first stage, a second portion having:

two faces that are aligned parallel to each other, and a second thickness between the two faces that determines a second width of the gap of the open seam profile to be formed during a second stage, wherein the second thickness is different than the first thickness, and a third portion having:

two faces that are aligned parallel to each other, and a third thickness between the two faces that determines a third width of the gap of the open seam profile to be formed during a third stage, wherein the third thickness is smaller than the second thickness.

16. Device for producing a longitudinally welded hollow profile from a sheet metal blank having defined longitudinal edges, the device comprising:

at least two tool parts, each tool part having a recess that determines an outer shape of at least one portion of the hollow profile to be produced and each tool part moveable relative to at least one other tool part to change a relative position of the tool parts, a mandrel having an outer shape that determines an inner shape of the hollow profile to be produced, a control mechanism that emits control signals for changing the relative position of the tool parts from a mutually distanced starting position into a shaping position, wherein the changing of the relative position occurs in at least two stages, and a holding-down device for holding down the mandrel, wherein the holding-down device is configured to be fed in a direction of the mandrel to form a guide for the longitudinal edges of the sheet metal blank, the holding-down device comprising:

a first portion having:

two faces that are aligned parallel to each other, and a first thickness between the two faces that determines a first width of a gap of the open seam profile to be formed from the sheet metal blank during a first stage, a second portion having:

two faces that are aligned parallel to each other, and a second thickness between the two faces that determines a second width of the gap of the open seam profile to be formed during a second stage, wherein the second thickness is different than the first thickness, and an upper portion having at least one oblique shoulder configured to deflect a longitudinal edge of the sheet metal blank impacting on the at least one oblique shoulder in the direction of the mandrel.

* * * * *